US008310405B2

(12) United States Patent
Minard et al.

(10) Patent No.: US 8,310,405 B2
(45) Date of Patent: Nov. 13, 2012

(54) SYSTEM OF DIVERSITY DIPOLE ANTENNAS

(75) Inventors: Philippe Minard, Saint Medard sur Ille (FR); Jean-François Pintos, Bourgbarre (FR); Ali Louzir, Rennes (FR); Philippe Gilberton, Geveze (FR); Jean-Luc Robert, Betton (FR); Corinne Nicolas, La Chapelle des Fougeretz (FR)

(73) Assignee: Thomson Licensing, Issy les Moulineaux (FR)

( * ) Notice: Subject to any disclaimer, the term of this patent is extended or adjusted under 35 U.S.C. 154(b) by 651 days.

(21) Appl. No.: 11/989,887

(22) PCT Filed: Jul. 19, 2006

(86) PCT No.: PCT/EP2006/064415

§ 371 (c)(1),
(2), (4) Date: Mar. 25, 2010

(87) PCT Pub. No.: WO2007/014855

PCT Pub. Date: Feb. 8, 2007

(65) Prior Publication Data

US 2010/0207837 A1 Aug. 19, 2010

(30) Foreign Application Priority Data

Aug. 1, 2005 (FR) ..... 05 52401

(51) Int. Cl.
*H01Q 9/28* (2006.01)
*H01Q 21/00* (2006.01)

(52) U.S. Cl. ..... 343/795; 343/793; 343/797; 343/702; 343/810; 343/893

(58) Field of Classification Search ..... 343/795, 343/810

See application file for complete search history.

(56) References Cited

U.S. PATENT DOCUMENTS

| | | | | |
|---|---|---|---|---|
| 5,451,965 | A | 9/1995 | Matsumoto | |
| 5,905,467 | A | 5/1999 | Narayanaswamy et al. | |
| 6,271,800 | B1 * | 8/2001 | Nakamura et al. | 343/797 |
| 7,106,253 | B2 * | 9/2006 | Yuanzhu | 343/700 MS |
| 7,642,968 | B2 * | 1/2010 | Minard et al. | 343/702 |
| 7,924,236 | B2 * | 4/2011 | Pintos et al. | 343/793 |
| 8,130,163 | B2 * | 3/2012 | Minard et al. | 343/793 |
| 2003/0090423 | A1 | 5/2003 | Horii | |
| 2005/0143151 | A1 | 6/2005 | Ito et al. | |
| 2007/0060089 | A1 * | 3/2007 | Owen et al. | 455/229 |
| 2009/0096697 | A1 * | 4/2009 | Pintos et al. | 343/793 |

FOREIGN PATENT DOCUMENTS

WO WO 03/073552 9/2003

OTHER PUBLICATIONS

Search Report Dated September 19, 2006, 3pgs.

* cited by examiner

*Primary Examiner* — Trinh Dinh
(74) *Attorney, Agent, or Firm* — Robert D. Shedd; Jeffrey M. Navon

(57) ABSTRACT

The present invention relates to a diversity antennas system comprising at least two antennas of the dipole type each formed by a first and a second conductive arm, supplied differentially wherein the two antennas comprise a common arm called first arm forming at least one cover for an electronic card and each one a second arm mounted in rotation at one extremity of the first arm.

13 Claims, 11 Drawing Sheets

$\alpha 1 = 0^{\circ}$ et $\alpha 2 = 90^{\circ}$

SYSTEM OF DIVERSITY DIPOLE ANTENNAS

This application claims the benefit, under 35 U.S.C. §365 of International Application PCT/EP2006/064415, filed Jul. 19, 2006, which was published in accordance with PCT Article 21(2) on Feb. 8, 2007 in French and which claims the benefit of French patent application No. 0552401, filed Aug. 1, 2005.

The present invention relates to diversity antennas system comprising at least two dipole type antennas. The present invention relates more particularly to a system of antennas of the above type for the reception of television signals, notably the reception of digital signals on a portable electronic device such as a laptop computer commonly called PC, a PVA (Personal Assistant) or for other similar devices requiring a system of antennas to receive electromagnetic signals. The present invention also relates to a support for the antenna system enabling it to be fitted to the portable device.

On the current market, there are items of equipment that can receive signals for digital terrestrial television or TNT directly on a laptop computer. The reception of digital terrestrial television signals on a laptop computer enables the computing power of the said computer to be used for decoding a digital image. This equipment is most frequently marketed in the form of a box with two interfaces, namely one RF (radiofrequency) interface for connection to an interior or exterior VHF-UHF antenna and a USB interface for the connection to the computer.

The devices currently on the market are generally constituted by a separate antenna such as a whip or loop type antenna mounted on a unit comprising a USB connector.

In the French patent application No. 05 51009 filed on Apr. 20, 2005, the applicant proposed a compact wideband antenna covering the entire UHF band, constituted by a dipole type antenna. This antenna is associated with an electronic card that can be connected to a portable device, notably by using a USB type connector.

More specifically, the antenna described in the French patent application No. 05 51009, comprises a first and a second conductive arm supplied differentially, one of the arms, called first arm, forming at least one cover for an electronic card. More specifically, the first arm has the form of a box into which the electronic card, which comprises the processing circuits of the signals received by the dipole type antenna, is inserted.

However, this solution although providing good results at the level of the reception, does not resolve the problems due to fading phenomena relating to multiple paths, particularly during reception within a building. In addition to the multiple paths, the signal undergoes extra attenuation to penetrate within the buildings. These disadvantages are encountered during any portable reception. To overcome these disadvantages, a person skilled in the art knows how to use a diversity antenna that enables the reception robustness to be improved, notably with respect to multiple path problems.

Hence, the present invention relates to a system of diversity antennas comprising at least two antennas of the dipole type each formed by a first and a second conductive arm, supplied differentially. The two antennas comprise a common arm called first arm forming at least one cover for an electronic card and each one a second arm mounted in rotation at one extremity of the first arm.

According to a first embodiment, the second arms are mounted in rotation at one extremity of the first arm around a common axis and, preferably, the second arms have identical profiles and complementary to the profile of the first arm so as to be able to fold back onto one of the faces of the first arm.

According to a second embodiment, each second arm is mounted in rotation to one extremity of the first arm around a specific axis. In this case, the second arms have identical profiles corresponding to the lateral walls of the box formed by the first arm. The second arms can also have complementary profiles enabling them to be folded onto one of the upper and/or lower faces of the first arm.

According to other characteristics of the present invention, the first arm has the form of a box, into which an electronic card is inserted, more particularly the electronic card used to process the signals received by the antenna and sends them to a portable display device such as a laptop computer or similar device. Hence, the electronic card comprises at one extremity at least two connection ports to supply each antenna of the system and at the other extremity a connection port formed, for example, by a USB connector enabling the connection to a portable electronic device such as a laptop computer or similar device.

According to yet another characteristic, the present invention relates to a support for the antenna system comprising an adjustable attachment means on the portable device and a means to receive the first arm of the system mounted in rotation on the attachment means.

Other characteristics and advantages of the invention will appear upon reading the description of different embodiments, this description being realized with reference to the enclosed drawings, wherein.

Figure 9:
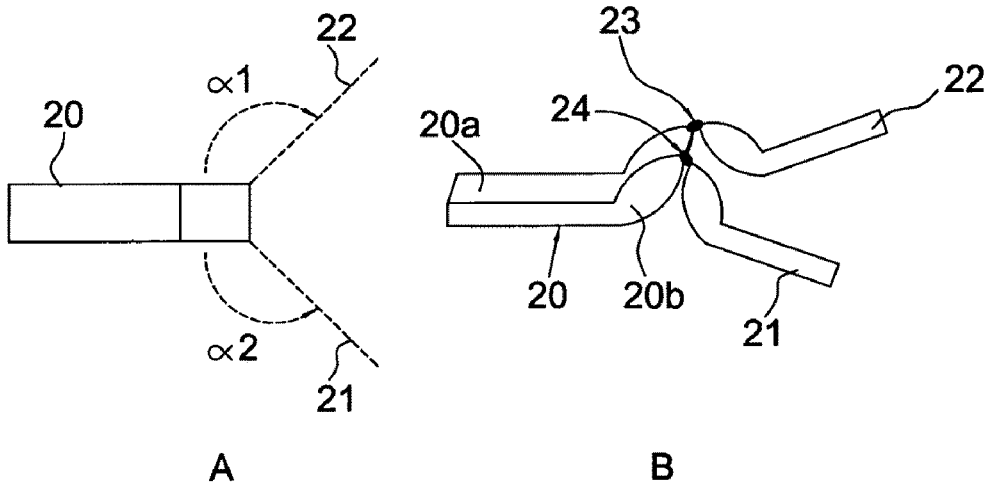
FIG. 9 shows respectively a top view at A and a diagrammatic perspective view at B of a second embodiment of an antenna system in accordance with the present invention.
Figure 12:
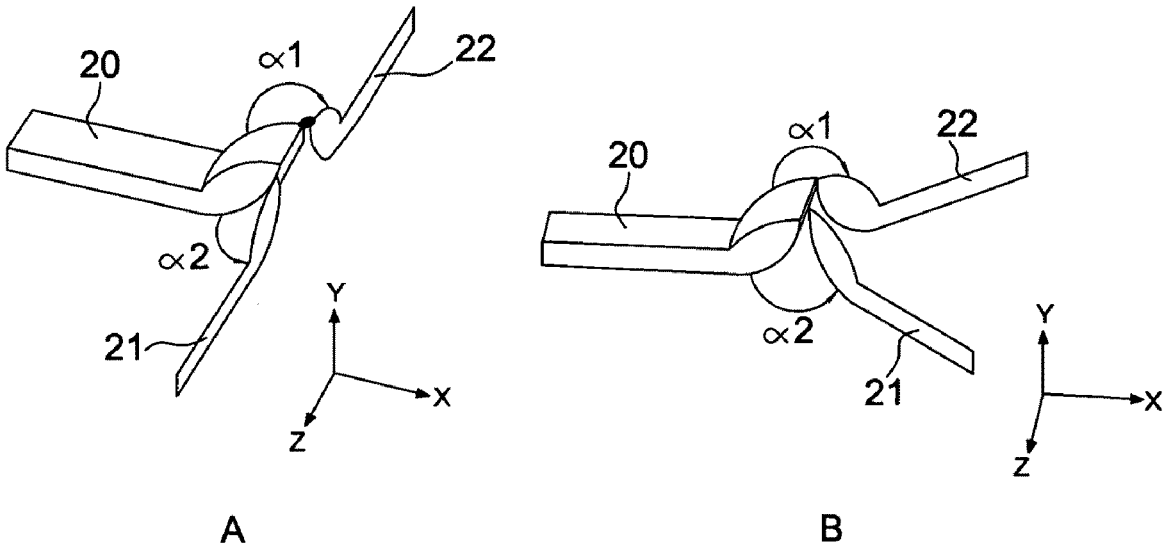

FIG. 12 shows a diagrammatic perspective view of an antenna system in accordance with the system of FIG. 9 with respectively at A an angle $\alpha=\alpha 1=\alpha 2=90°$ and at B an angle $\alpha=\alpha 1=\alpha 2=135°$.

Figure 13:
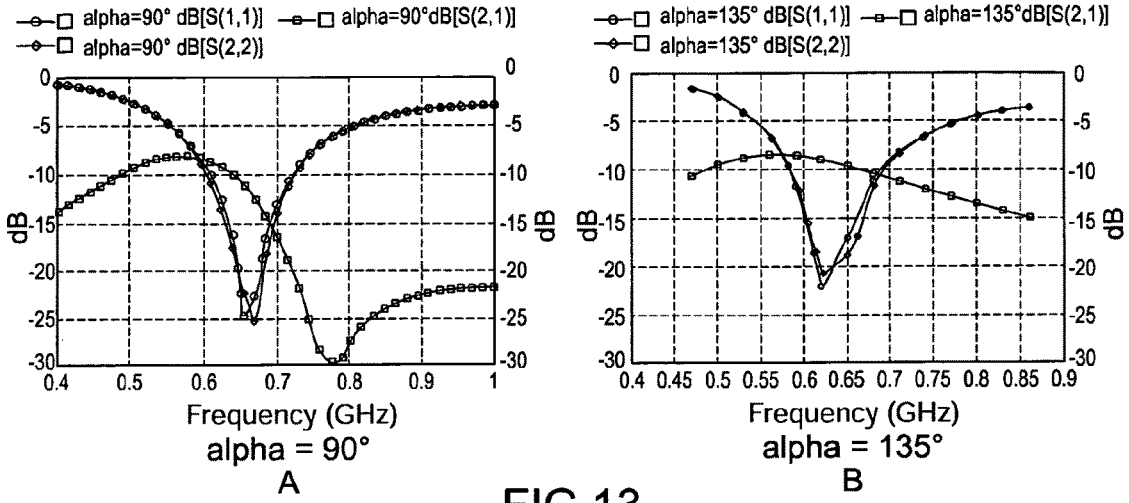

FIG. 13 shows respectively the impedance matching and isolation curves of the antenna system shown in FIG. 12, respectively at A for an angle $\alpha=90°$ and at B for an angle $\alpha=135°$.

Figure 14:
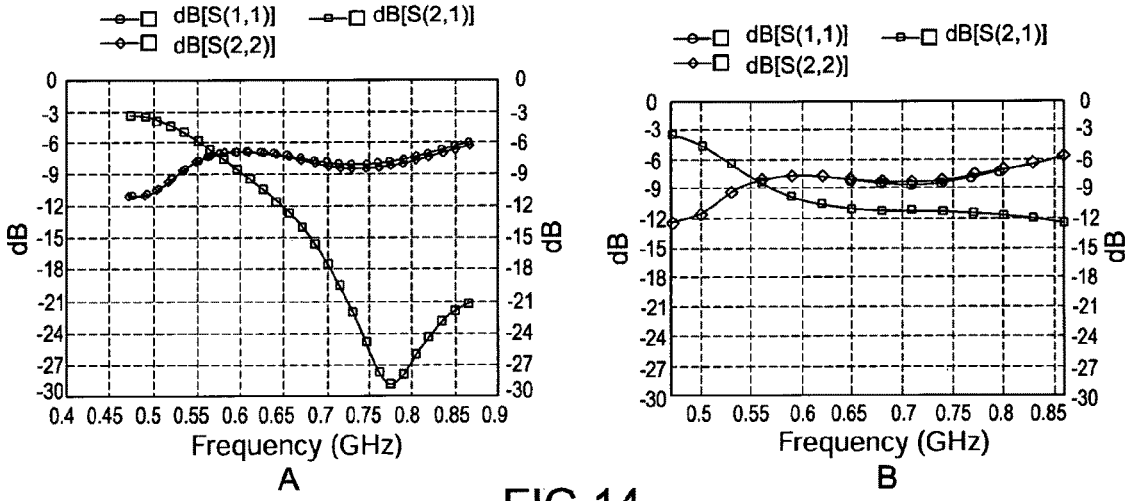

FIG. 14 shows respectively the impedance matching and isolation curves of the antenna system shown in FIG. 12 with impedance matching circuit, respectively at A for an angle $\alpha$=90° and at B for an angle $\alpha$=135°.

Figure 15:
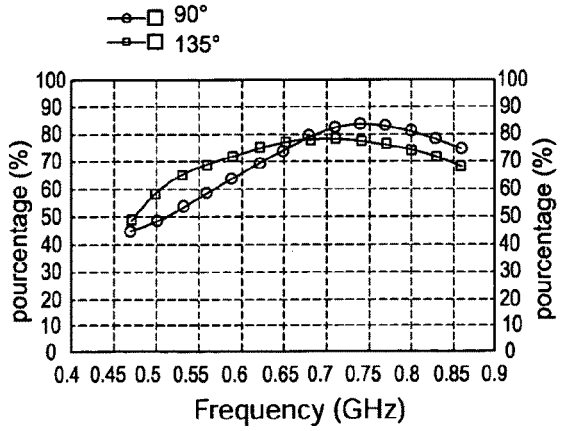

FIG. 15 shows the efficiency curves of the antenna system of FIG. 12.

Figure 16:
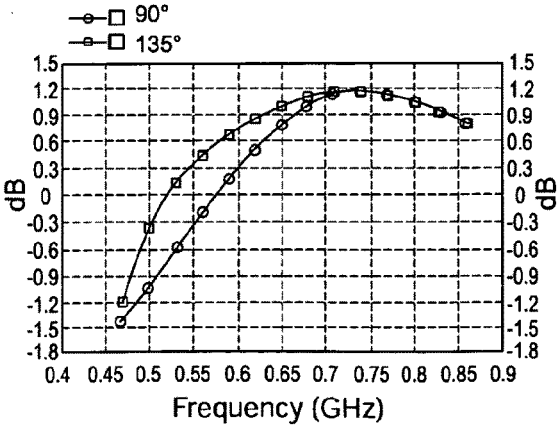

FIG. 16 shows the gain curves of the antenna system of FIG. 12.

Figure 17:
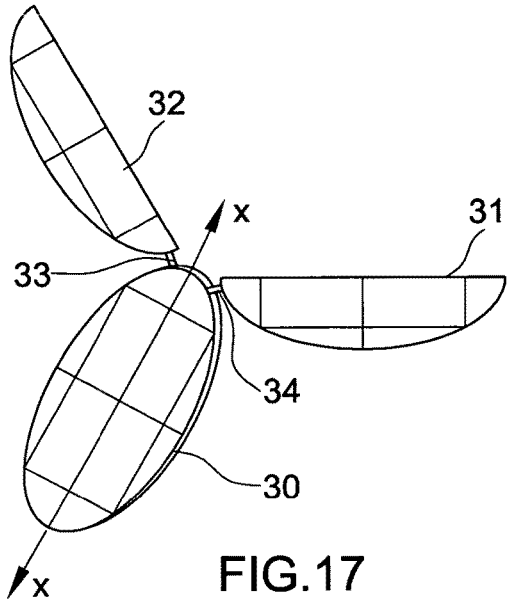

FIG. 17 shows another embodiment of an antenna system in accordance with the present invention.

Figure 18:
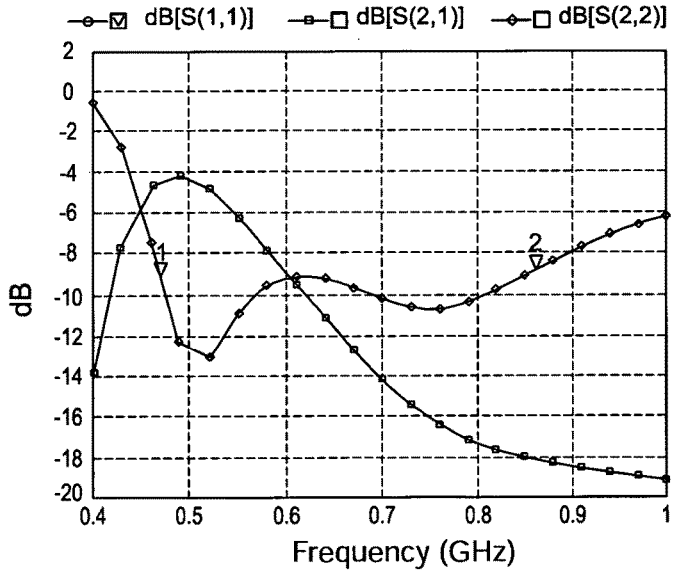

FIG. 18 shows the simulation results obtained for an antenna system as shown in FIG. 17.

Figure 19:
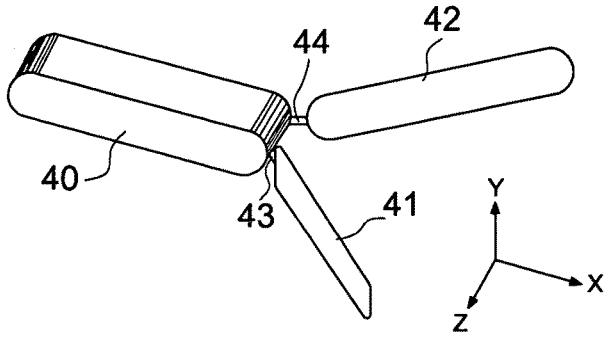

FIG. 19 diagrammatically shows in perspective another embodiment of an antenna system in accordance with the present invention.

Figure 20:
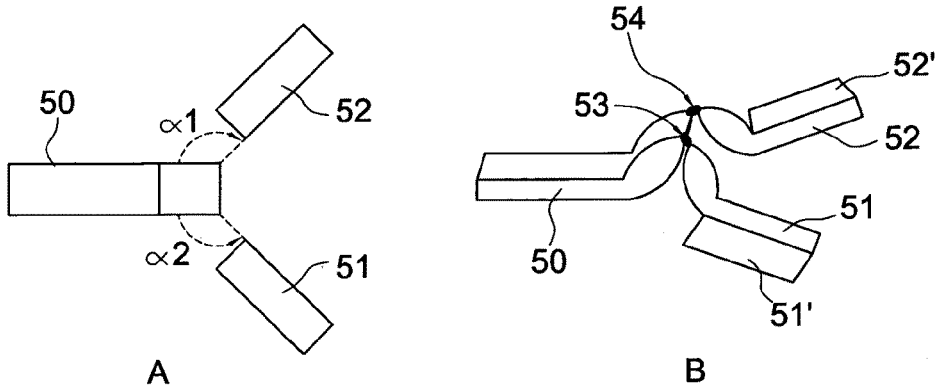

FIG. 20 shows a top view at A and a diagrammatic perspective view at B of another embodiment of an antenna system in accordance with the present invention.

Figure 21:
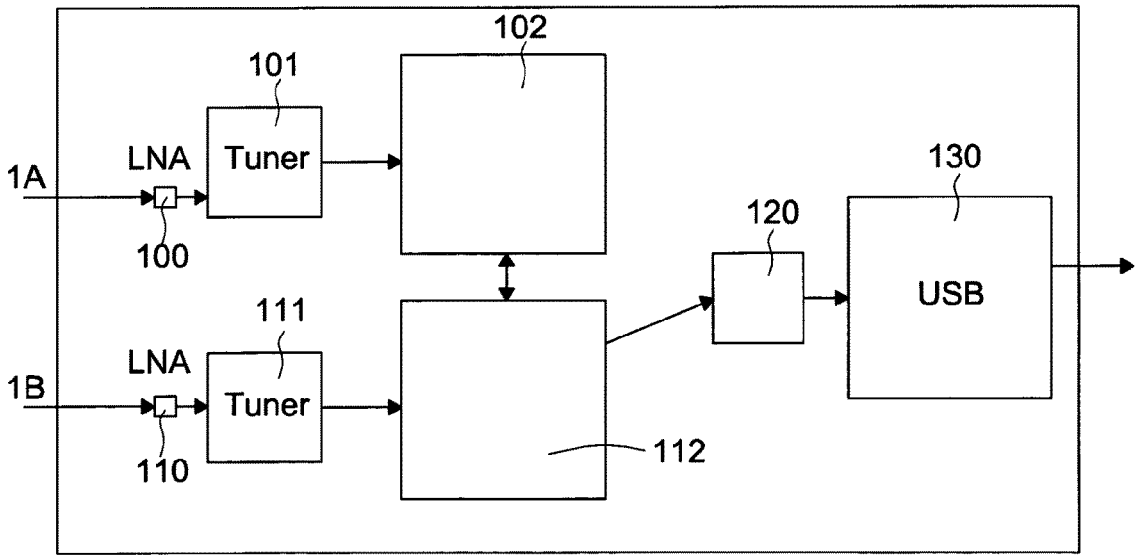

FIG. 21 diagrammatically shows an electronic card used with an antenna system in accordance with the present invention.

Figure 22:
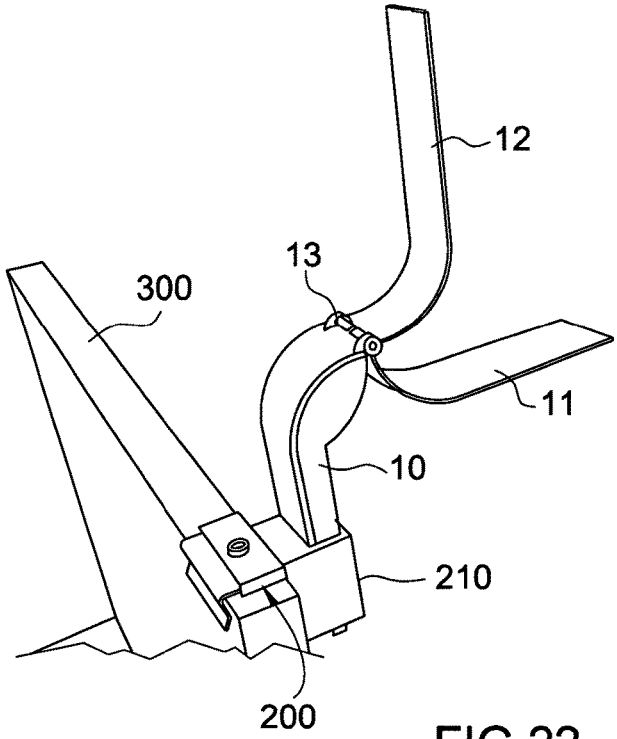

FIG. 22 shows in perspective a support for the antenna system in accordance with the invention.

Figure 23:
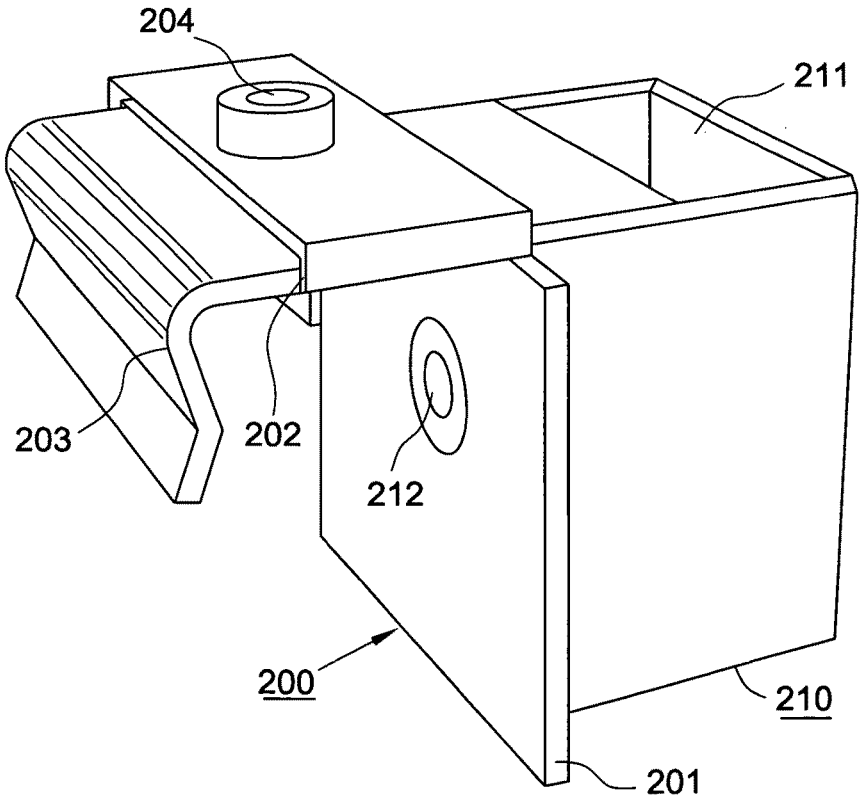

FIG. 23 shows an enlarged perspective view of the support of FIG. 22.

Figure 1:
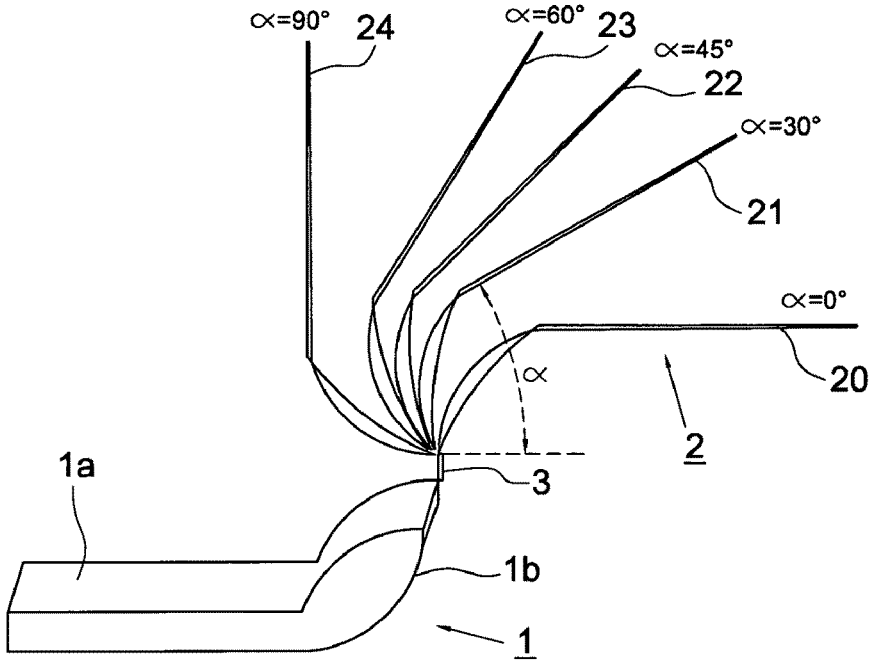
FIG. 1 is a diagrammatic perspective view of an antenna as described in the French patent application 05 51009 in the name of the applicant.
Figure 2:
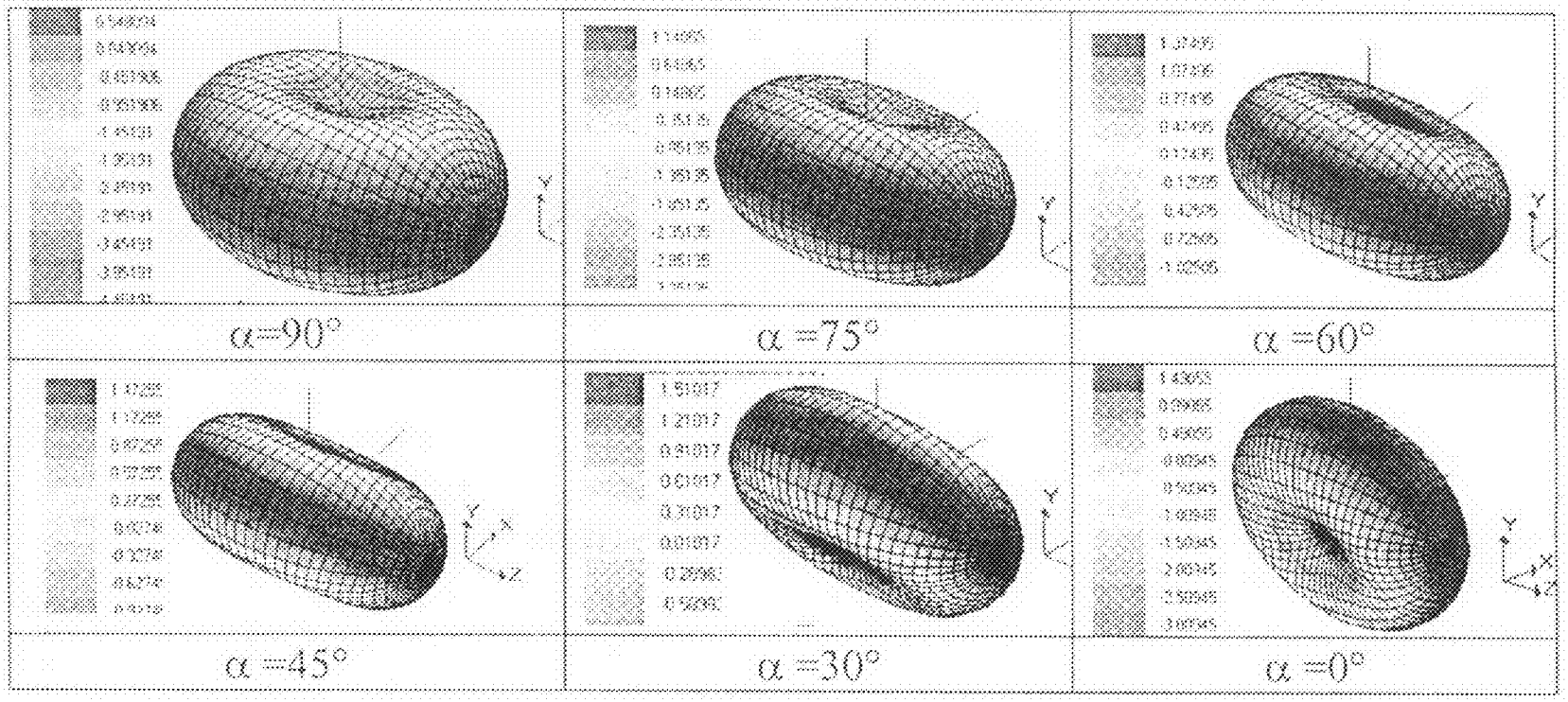
FIG. 2 shows the gain radiation patterns of the antenna of FIG. 1, for the different positions of the second arm 2.

With reference to FIGS. 1 and 2, a description will first be made of an embodiment of a dipole type antenna that can be used for receiving terrestrial digital television on a laptop computer in accordance with the French patent application no. 05 51009 in the name of the applicant.

As shown in FIG. 1, this dipole type antenna comprises a first conductive arm 1 and a second conductive arm 2, both arms being connected to each other by means of an articulation zone 3 located at one of the extremities of each of the arms. In a more specific manner, the arm 1 noticeably has the form of a box with a part 1*a* of a noticeably rectangular form extending by a curved part 1*b* opening out gradually to allow the energy to be radiated gradually thus increasing the impedance matching over a wider frequency band. The length of the arm 1 is noticeably equal to $\lambda/4$ where $\lambda$ is the wavelength at the central operating frequency. Hence, the length of the arm 1 approaches 112 mm for an operation in the UHF band (band between 470 and 862 MHz).

As shown in FIG. 1, the antenna comprises a second arm 2 mounted in rotation around the axis 3 which is also the point of connection of the antenna to the signal processing circuit. The electrical connection of the antenna is made by a metal strand, for example a coaxial or similar cable, whereas the rotation axis is made of a material relatively transparent to electromagnetic waves In FIG. 1, different orientations for the arm 2 are shown, namely a first orientation for which the arm 2 makes an angle $\alpha$=0° in relation to the horizontal referenced 20, a second orientation with an angle $\alpha$=30° referenced 21, a third orientation with an angle $\alpha$=45° referenced 22, a fourth orientation with an angle $\alpha$=60° referenced 23 and a fifth orientation with an angle $\alpha$=90° referenced 24. The arm 2 whose length is noticeably equal to $\lambda/4$, has a curved profile followed by a flat rectangular part, enabling the arm 2 to be folded back fully against the arm 1 in closed position. The arm 2 being mounted in rotation with respect to the arm 1, this enables the orientation of the arm 2 to be modified so as to optimise the reception of the television signal.

FIG. 2 shows the simulated radiation pattern of an antenna in accordance with the antenna shown in FIG. 1 at a frequency of 660 MHz for the various positions of the arm 2 shown in FIG. 1. The radiation patterns are tilted according to the angle of inclination of the arm. This inclination can thus optimise the reception of the digital television signal.

A description will now be given, with reference to FIGS. 3 to 8, of a first embodiment of a diversity antenna system in accordance with the present invention realised by using the principle of the antenna described with reference to FIGS. 1 and 2.

Figure 3:
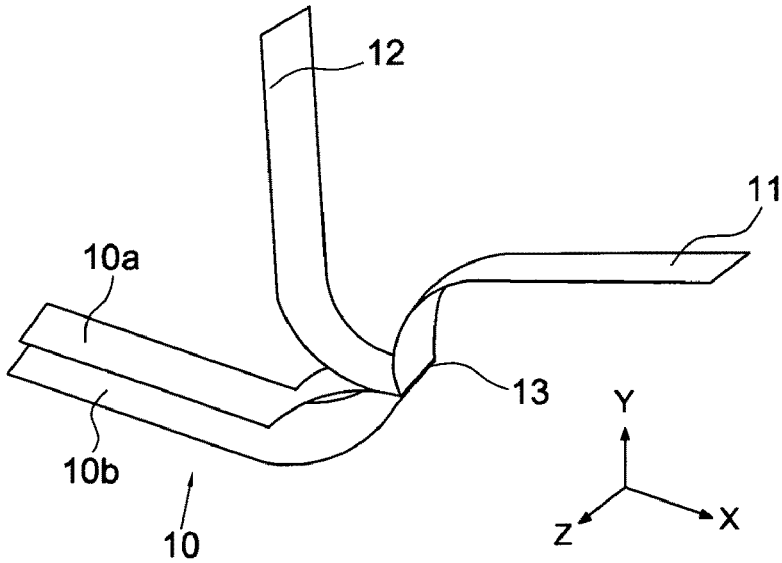
FIG. 3 is a diagrammatic perspective view of a first embodiment of an antenna system in accordance with the present invention.

As shown in FIG. 3, an antenna system in accordance with the present invention comprises two antennas constituted by a first common arm 10 forming at least the cover 10*a* of an electronic card enabling the signal received by the antenna to be processed. In the embodiment shown, the common arm 10 comprises an upper part or element forming cover 10*a* and a lower part 10*b*, the assembly forming a box to receive an electronic card for processing the received signals. Simulations were performed on a system as shown in FIG. 3 and having the following characteristics: 1) the material used is copper of conductivity $4.9*10^{e}7$S/m, 2) the length of the arm 11 is approximately equal to 112 mm, 3) the radius of curvature used for the parts 10*a*, 10*b*, 11, 12 is 31 mm, 4) the width of the arms 10, 11 and 12 is around 25 mm in such a manner as to be able to insert the electronic card of width 20 mm. The results obtained during the simulation performed in a known manner by using the software IE3D, are given in FIGS. 4 to 8.

Figure 4:
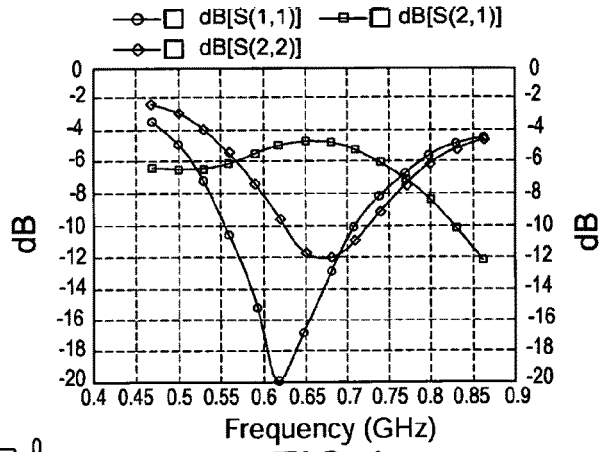
FIG. 4 shows the impedance matching and isolation curves with no impedance matching circuit for an antenna system according to FIG. 3.
Figure 5:
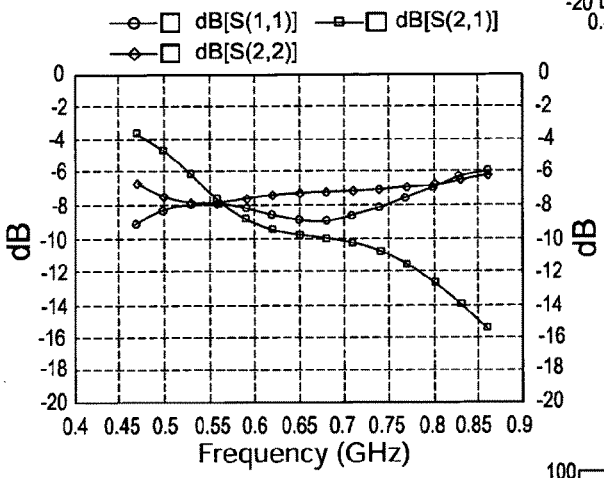
FIG. 5 shows the impedance matching and isolation curves with an impedance matching circuit for an antenna system according to FIG. 3.

FIG. 4 shows the impedance matching curves S(1,1) and S(2,2) and the isolation curve S(2,1) of the antenna system of FIG. 3 when the second arms form an angle $\alpha$1=0° and $\alpha$2=90° in relation to the first arm, namely for a second arm 11 oriented according to the horizontal and a second arm 12 oriented according to the vertical in relation to the first arm 10, the curves are simulated with a system without an impedance matching cell. In this case, the curves show that the impedance matching is realized on a relatively narrow band that can be improved by using an impedance matching cell. This cell is constituted in a standard manner by an LC circuit. The impedance matching and isolation curves with impedance matching cell are shown in FIG. 5. In this case, the impedance matching is performed on a larger frequency band.

Figure 6:
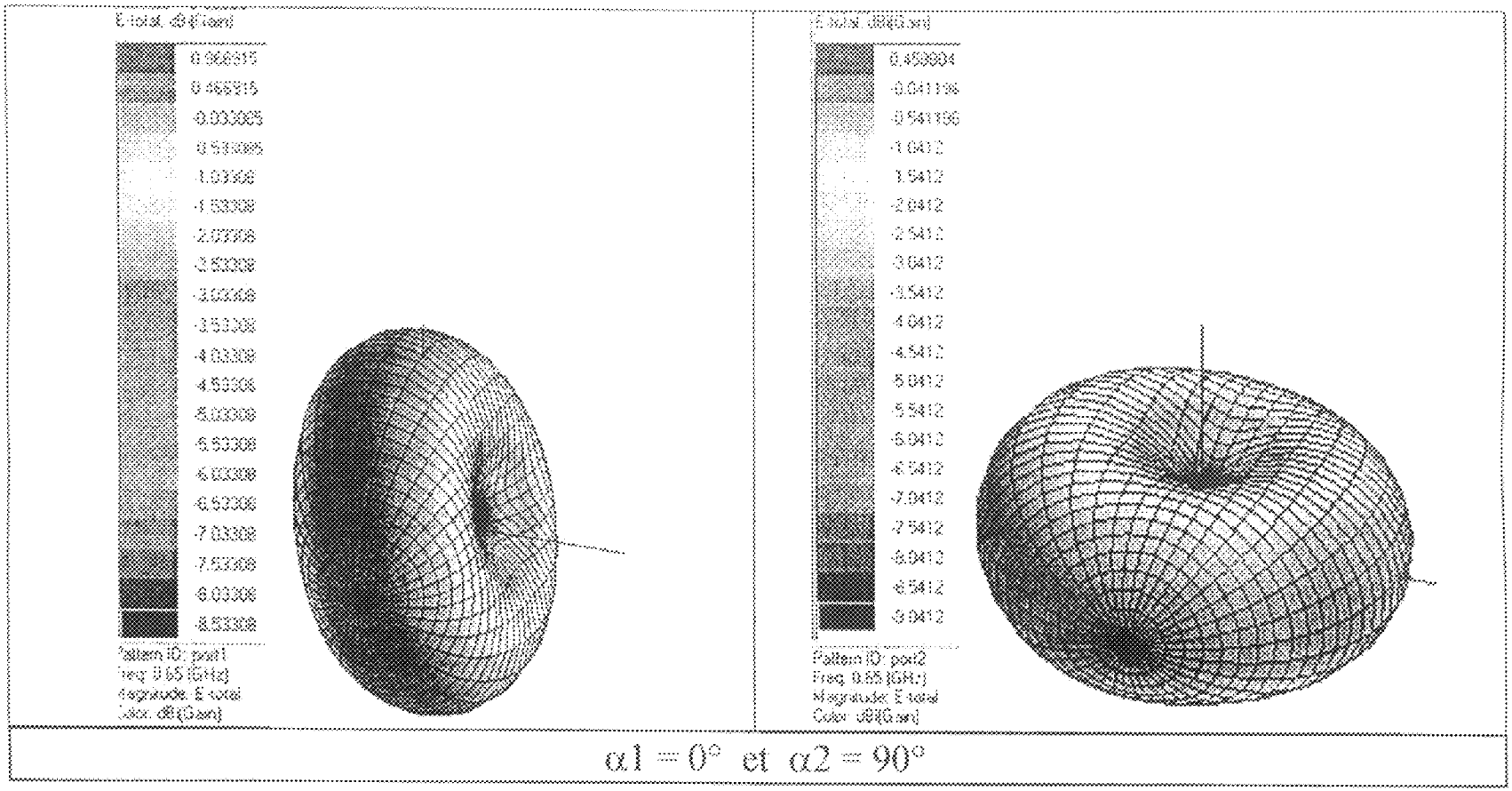
FIG. 6 shows the radiation patterns of an antenna system according to FIG. 3 respectively for an angle $\alpha 1=0°$ and for an angle $\alpha 2=90°$.

The isolation between the first antenna formed by the first arm 10 and the second arm 11 and the second antenna formed by the first arm 10 and the second arm 12, is sufficient to provide a notable diversity gain, particularly by taking into account the vertical polarizations for the first antenna and horizontal for the second antenna as well as strong radiation pattern decorrelations as is shown in FIG. 6.

The radiation patterns of FIG. 6 show a maximum decoupling and an optimum decorrelation between the two accesses when the two second branches 11, 12 are positioned perpendicularly to each other. Hence, according to an advantageous characteristic of the present invention, the two arms 11 and 12 are maintained at perpendicular positions to each other irrespective of the angle $\alpha$ of the first antenna, for example namely the antenna constituted by the first common arm 10 and the second arm 11.

Figure 7:
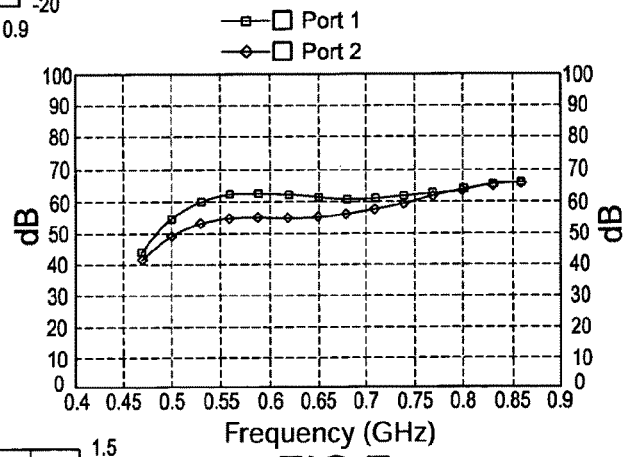
FIG. 7 shows the efficiency of the antenna system of FIG. 3 in the UHF bandwidth for $\alpha 1=0°$ and $\alpha 2=90°$ with an impedance matching circuit.
Figure 8:
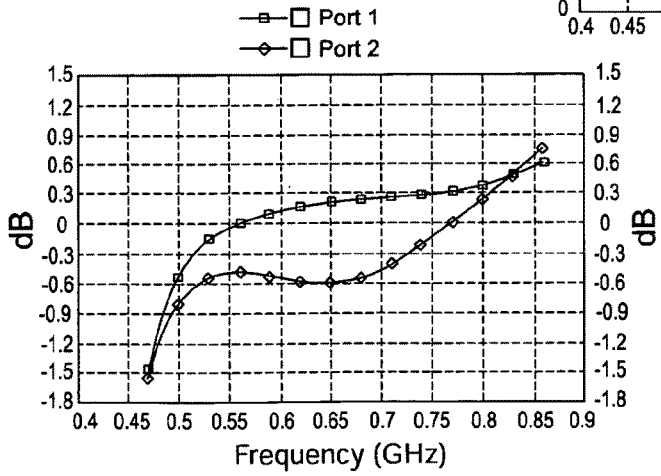
FIG. 8 shows the gain of the antenna system of FIG. 3 in the UHF bandwidth for $\alpha 1=0°$ and $\alpha 2=90°$ with an impedance matching circuit.

FIG. 7 shows the efficiency of an antenna system as shown in FIG. 3 for angles $\alpha$1=0° and $\alpha$2=90° on the entire UHF band whereas FIG. 8 shows the gain of the two accesses for the same antenna system. In this case, the yield of the antenna system is greater than 50% over almost the entire UHF band, which meets the performances required. An average gain of around 0 dBi over the entire UHF band corresponds to a directivity of 3 dBi for this type of antenna with an efficiency of 50%.

A description will now be given, with reference to FIGS. 9 to 11, of another embodiment of an antenna system in accordance with the present invention.

As shown in FIG. 9, the antenna system comprises two dipole type antennas formed from a first arm 20 common to both antennas. Each antenna comprises a second arm 21, 22 mounted in rotation at one extremity of the first arm. Each second arm 21, 22 pivots independently around two separate rotation axes 23, 24. In this embodiment, the two arms 21, 22 can form the lateral walls of the first common arm 20, as will be explained in more detail below.

As in the previous embodiment, the first common arm 20 comprises a rectangular part 20*a* forming a box for an electronic card intended, for example, for the processing of electromagnetic signals received or emitted by the antenna systems. The rectangular part 20*a* is extended by a curved part 20*b* opening out gradually. The two second arms 21, 22 have a profile adapted to the lateral parts of the first conductive arm 20. In a more precise manner, they have a noticeably rectangular part extending by a curved part.

As shown on the part A of FIG. 9, the arms 21 and 22 can be oriented in relation to the first arm 20 according to angles $\alpha 1$ and $\alpha 2$ that therefore represent the angle of opening between respectively the second arm 22 and the arm 20 and the second arm 21 and the arm 20. The two rotation axes 23 and 24 being distant from each other, it is observed, in addition to a radiation diversity, a spatial diversity related to the spatial separation of the two antennas formed by the dipoles 21, 20 and 22, 20.

Figure 10:
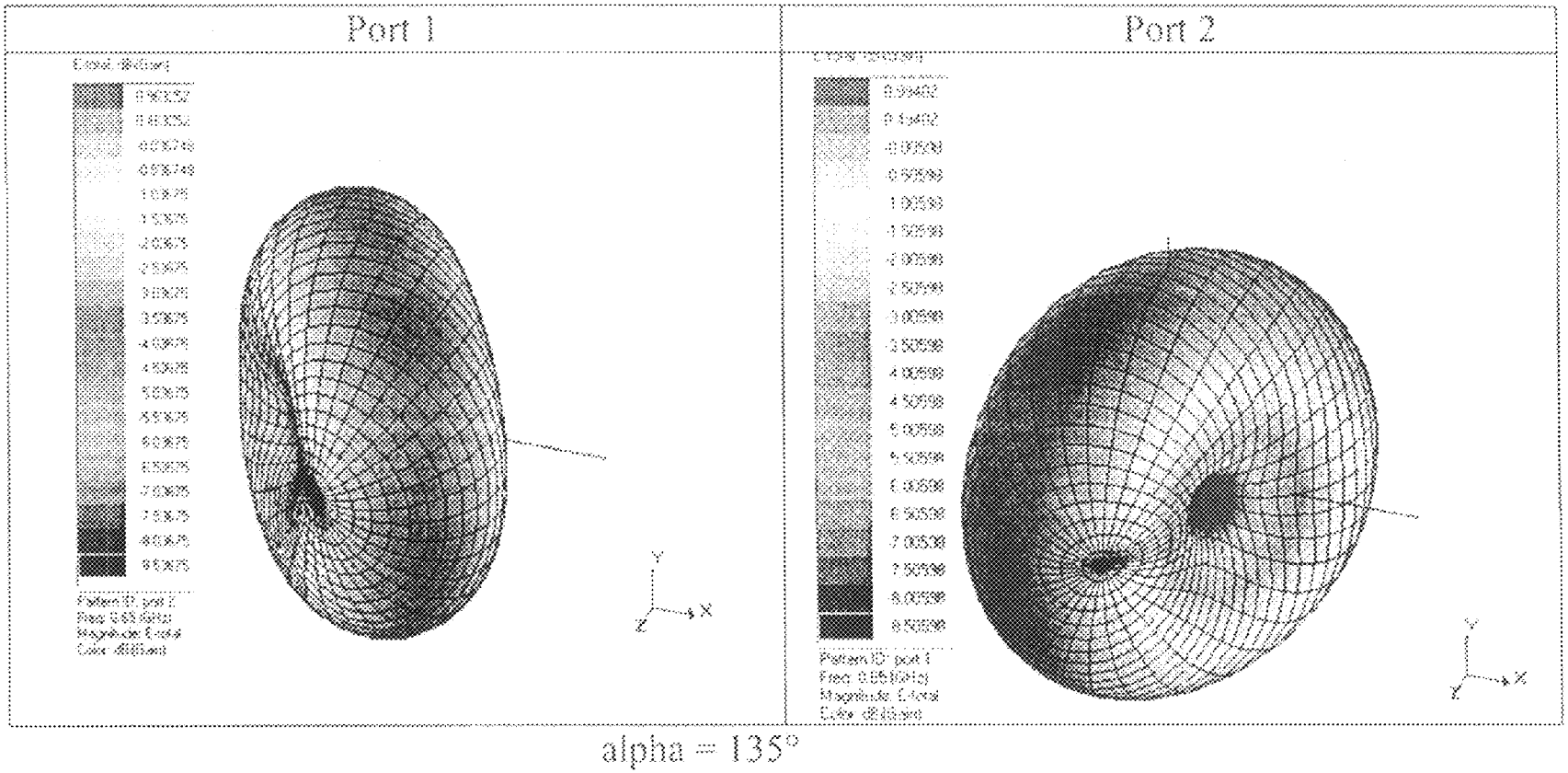
FIG. 10 shows the radiation patterns for the system of FIG. 9 with an angle $\alpha$ equal to 135°, respectively for a supply on the port 1 and for a supply on the port 2.
Figure 11:
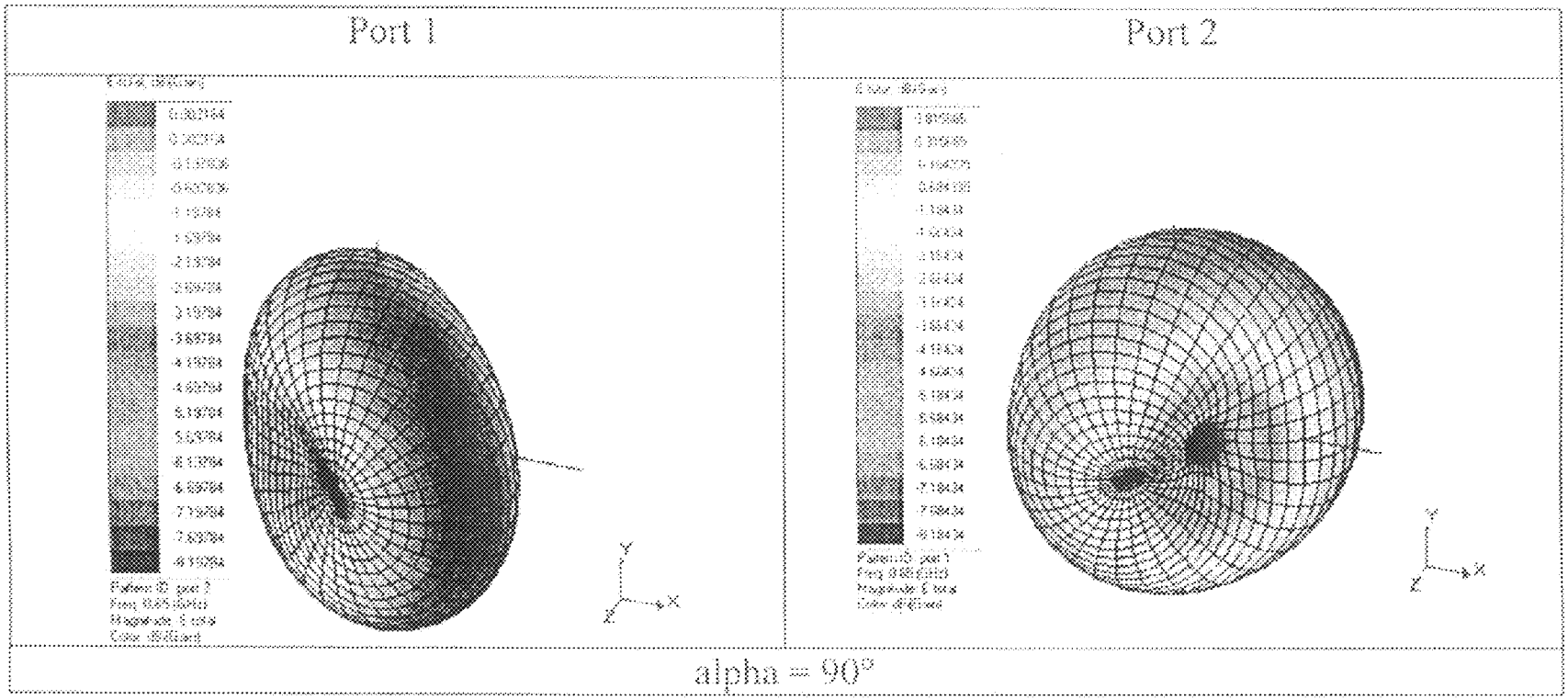
FIG. 11 shows the radiation patterns for the antenna system of FIG. 9 when the angle $\alpha$ is equal to 90°, respectively for a supply on the port 1 and for a supply on the port 2.

This is observed notably on the radiation patterns of FIGS. 10 and 11 that show respectively the radiation patterns for the port 1 and port 2 for distance $\alpha=\alpha 1=\alpha 2=135°$ between the two arms 20, 21 and 20, 22 in FIG. 10 and for a distance $\alpha=\alpha 1=\alpha 2=90°$ between the two arms 20, 21 and 20, 22 in FIG. 11.

In FIG. 12, an antenna system comprising a first common arm 20 and two second arms 21, 22 is shown in a more precise manner at A, the second arms being positioned with respect to the first arm such that the angle $\alpha=\alpha 1=\alpha 2=90°$. Similarly, at B, an identical antenna system is shown but in this case the angle $\alpha=\alpha 1=\alpha 2=135°$. The two seconds arms 21 and 22 being mounted in rotation around two separate axes 23, 24 provided at the extremity of the first arm 20, it is possible to turn them in such a manner that in the unused position, the two arms 21, 22 fold back onto the lateral faces of the first common arm 20 giving a compact system that can be transported easily when it is not in use.

FIG. 13 thus respectively shows, for the system of FIG. 12, the impedance matching and isolation curves between the two antenna without an impedance matching circuit for an angle $\alpha=90°$ at A and $\alpha=135°$ at B. The antenna has a natural impedance matching around the operating central frequency but not over the entire UHF band for the two values of $\alpha$. The isolation difference for the two values of $\alpha$ is proportional to the correlation of the patterns of the antenna system. Depending on the frequency channel used, this enables the isolation to be adjusted and therefore the effect required by the use of the diversity to be improved.

Similarly, FIG. 14 shows the impedance matching and isolation curves between the two antennas respectively for an angle $\alpha=90°$ at A and $\alpha=135°$ at B in the case where an impedance matching circuit is connected at the output of the antenna system. The impedance matching circuit here enables the impedance matching bandwidth to be enlarged, considered for a level of S11 at −6 dB, which is a typical value for the application targeted. The comment regarding the isolation of FIG. 13 also applies here.

FIG. 15 shows the efficiency curves of the system whereas FIG. 16 shows the gain curves for the two antennas of the antenna system described above. The efficiency of the antenna system is greater than 60% over almost the entire UHF band, which results in a good performance for the targeted application. An average gain of around 0.5 dBi over the entire UHF band corresponds to a directivity of 3 dBi for this type of antenna with an efficiency of 60%.

A description will now be given, with reference to FIGS. 17 and 18, of another embodiment of an antenna system in accordance with the present invention. In this case, the first arm or common arm 30 has a noticeably elliptical form with a main axis x, x. Near one extremity of the main axis x, x, the two second arms 31, 32 of the two dipole type antennas are mounted around two separate axes 33, 34. These two arms have the form of a half-ellipse. The two arms 31, 32 are mounted in rotation in such a manner as to be able to fold respectively onto the upper face and lower face of the common arm 30. A two-antenna system of this type was simulated and FIG. 18 shows the impedance matching and isolation curves of such an antenna. The characteristics used for the simulation are as follows: 1) the material used is copper of conductivity $4.9*10^{e}7$S/m, 2) the two axes of the ellipse for the elements 30, 31 and 32 have the dimensions, 25 mm and 50 mm respectively, 3) the thickness of the box is 12 mm, which enables the electronic card of thickness 10 mm to be inserted into it.

A description will now be given, with reference to FIGS. 19 and 20, of other embodiments of an antenna system of the same type as shown in FIG. 9.

In FIG. 19, the diversity antenna system in accordance with the present invention comprises a first common arm 40 having a form of an oblong box. At the extremity of the box 40, two separate axes 43, 44 are provided for on which are respectively mounted a first second arm 41 and an second second arm 42 to obtain the two dipole type antennas forming the antenna system in accordance with the invention. These arms 41 and 42 of oblong form can turn around the axes 43 and 44 and be folded back on the lateral sides of the first common arm 40 forming the box.

In FIG. 20, another embodiment of an antenna system in accordance with the present invention is shown. In this case, the system comprises a first common arm 50. This arm has an identical form to the first arm 30 of the embodiment of FIG. 9. At the tapered extremity of the arm 50, two separate rotation axes 53, 54 are designed on which a first second arm 51 and a second second arm 52 are respectively mounted. The first second arm 51 has a part being able to be folded back onto the lateral face of the first arm 50. This part 51 extends perpendicularly by a rectangular element 51' being folded under the arm 50 whereas the second second arm 52 has a main part 52 being able to be folded back onto the lateral face of the element 50, said part 52 extending by a perpendicular rectangular part 52' that is folded back onto the upper part of the element 50.

A description will now be given, with reference to FIG. 21, of an embodiment of an electronic card being able to be integrated into the box or under the cover formed by the first common arm of the system in accordance with the present invention. This electronic card comprises in a diagrammatic manner, a first LNA amplifier (Low Noise Amplifier) 100 connected at 1A to one of the antennas of the antenna system in accordance with the present invention. The LNA amplifier 100 is connected to a tuner 101 itself connected to a demodulator 102. In parallel, the card comprises a second LNA amplifier 110 connected at 1B to the second antenna. LNA 110 is connected to a tuner 111 connected to a demodulator 112. Both demodulators 102 and 112 are interconnected in such a manner as to have a master demodulator, namely 112 in the embodiment shown and a slave demodulator, namely 102 in the embodiment shown. The output of the master demodulator 112 is connected to a USB interface 120, itself connected to a USB connector 130 enabling the antenna system to be connected to the USB socket of a portable terminal such as a laptop or PC or any other device of the same type.

A description will now be given, with reference to FIGS. 22 and 23, of an embodiment of a support for the antenna system described above. As shown, the support comprises an element 210 in the form of a box to receive the common arm 10 of the antenna system of the present invention. The element 110 comprises an upper opening 211 suitable to receive said arm and a lower opening enabling the connection to a connector of the portable device such as a USB connector. The element 210 is mounted in rotation around the axis 212 on an attachment means 200 enabling the antenna support to be attached to a device, more particularly the screen 300 of a laptop computer.

The attachment means 200 comprises an L-shaped element 201 on which is mounted the element in the form of a box 210. The perpendicular part of the L-shaped element has an opening 202 forming a slide. A second L-shaped element 203 is inserted into this slide, the two L-shaped elements 202 and 203 forming a gripping clamp on the screen 300. The element 203 is equipped on its part inserting into the slide with an oblong hole not shown. Once in position, the distance between the element 203 and the element 201 is maintained by a tightening means 204 such as a tightening screw or similar. Furthermore, to efficiently maintain the support on the screen, the free part of the second L-shaped element is curved inwards, strengthening the gripping effect.

With the device described above, a first adjustment enables the support to be tightened onto the screen in such a manner as to be adjusted on any type of screen. Once the mechanical link is set up between the screen 300 and the support, a second adjustment can be performed by turning the element 210 receiving the antenna system around the pin 212 to orient the antennas in such a manner as to optimise the reception quality for a given channel.

The invention claimed is:

1. A diversity antennas system comprising at least two antennas of the dipole type each formed by a first and a second conductive arm, supplied differentially, wherein the two antennas comprise a common arm called first arm forming at least one cover for an electronic card and each one a second arm mounted in rotation at one extremity of the first arm.

2. The system according to claim 1, wherein the first arm has the form of a box into which the electronic card is inserted.

3. The system according to claim 1, wherein the first and second arms each have a length noticeably equal to $\lambda/4$ where $\lambda$ is the wavelength at the operating central frequency.

4. The system according to claim 1, wherein the second arms are mounted in rotation at one extremity of the first arm around a common axis.

5. The system according to claim 4, wherein the second arms have identical profiles and complementary to the profile of the first arm so as to be able to fold back onto one of the faces of the first arm.

6. The system according to claim 1, wherein each second arm is mounted in rotation at one extremity of the first arm around a specific axis.

7. The system according to claim 6, wherein the second arms have identical profiles corresponding to the lateral walls of the box for electronic card formed by the first arm.

8. The system according to claim 6, wherein the second arms have complementary profiles enabling them to be folded back onto one of the faces of the first arm.

9. The system according to claim 1, wherein the electronic card comprises, at one extremity, at least two connection ports for supplying each antenna and at the other extremity a connection port to an electronic appliance.

10. The support for an antenna system according to claim 1, wherein the support comprises an adjustable attachment means on an appliance and a means to receive one of the arms of the antenna system.

11. The support according to claim 10, wherein the adjustable attachment means is constituted by two L-shaped elements each sliding in the other in such a manner as to form an adjustable grip.

12. The support according to claim 10, wherein the means for receiving one of the arms of the antenna system is constituted by an element is the form of a box featuring at least one opening to receive one of the arms of the antenna system.

13. The support according to claim 1, wherein the box-shaped element is fixed in rotation on the adjustable attachment means.

* * * * *